US010667030B2

(12) United States Patent
Wexler et al.

(10) Patent No.: US 10,667,030 B2
(45) Date of Patent: May 26, 2020

(54) EARPIECE TIP AND RELATED EARPIECE

(71) Applicant: Bose Corporation, Framingham, MA (US)

(72) Inventors: Ryan Joseph Wexler, Boston, MA (US); Christopher Paetsch, Boston, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/118,727

(22) Filed: Aug. 31, 2018

(65) Prior Publication Data

US 2020/0077173 A1 Mar. 5, 2020

(51) Int. Cl.
*H04R 1/10* (2006.01)
*H04R 25/00* (2006.01)

(52) U.S. Cl.
CPC ..... *H04R 1/1016* (2013.01); *H04R 1/1058* (2013.01); *H04R 1/1083* (2013.01); *H04R 1/105* (2013.01); *H04R 25/652* (2013.01)

(58) Field of Classification Search
CPC .. H04R 1/1016; H04R 1/1058; H04R 1/1083; H04R 1/105; H04R 25/652
USPC ..... 381/182, 374
See application file for complete search history.

(56) References Cited

U.S. PATENT DOCUMENTS

| | | | | |
|---|---|---|---|---|
| 3,725,986 | A * | 4/1973 | Hoogenboom | B06B 1/0607 29/25.35 |
| 4,055,233 | A | 10/1977 | Huntress | |
| 5,957,136 | A | 9/1999 | Magidson et al. | |
| 6,129,175 | A | 10/2000 | Tutor et al. | |
| 8,249,287 | B2 | 8/2012 | Silvestri et al. | |
| 8,737,669 | B2 | 5/2014 | Monahan et al. | |
| 2004/0163653 | A1 | 8/2004 | Fleming | |
| 2016/0073192 | A1* | 3/2016 | Briggs | H04R 1/1058 381/380 |
| 2017/0311069 | A1 | 10/2017 | Prevoir et al. | |
| 2018/0038143 | A1* | 2/2018 | Novin | E05D 5/14 |

* cited by examiner

*Primary Examiner* — Alexander Krzystan
(74) *Attorney, Agent, or Firm* — Hoffman Warnick LLC

(57) ABSTRACT

Various implementations include an eartip for an earphone earpiece. The eartip can be configured to reliably fit a plurality of ear shapes. The eartip can have a body and a sealing structure defined by a set of dimensions that are configured to seal the ear canal of one or more users. In certain implementations, a notch in the body permits flexion of the body during coupling or decoupling of the body from the mount and provides sufficient hoop stress around the mount to retain the eartip on the mount during use of the earphone earpiece.

19 Claims, 11 Drawing Sheets

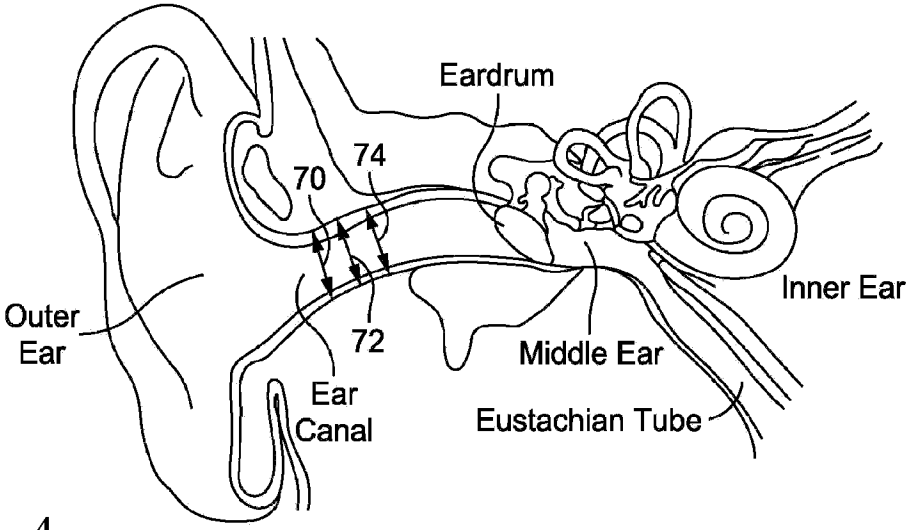
FIG. 4
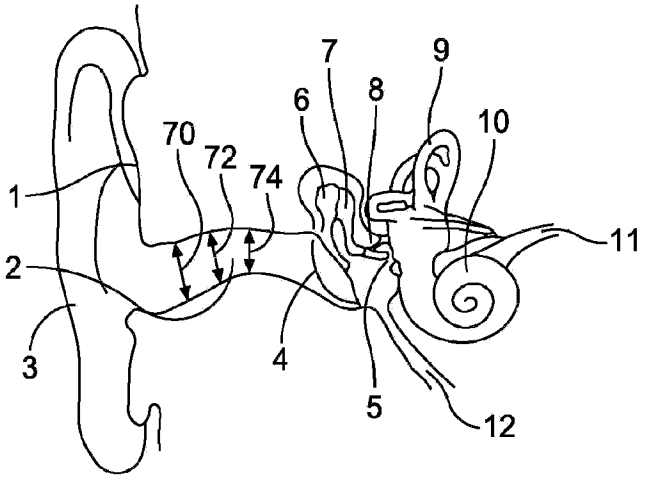
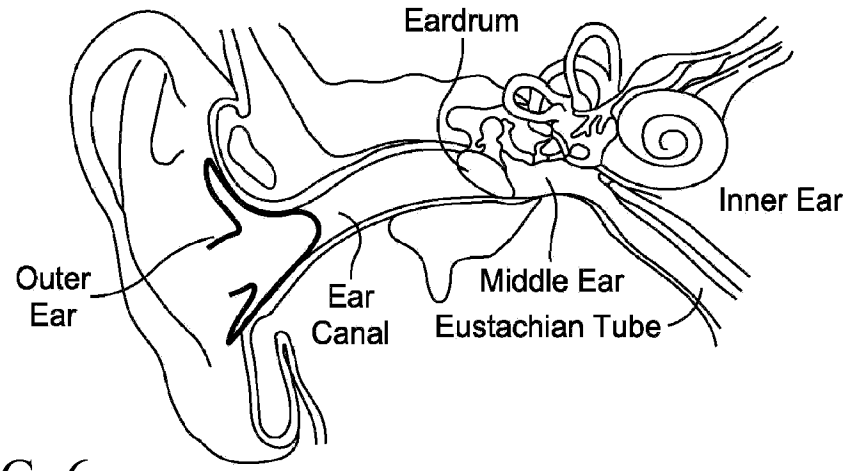
FIG. 6
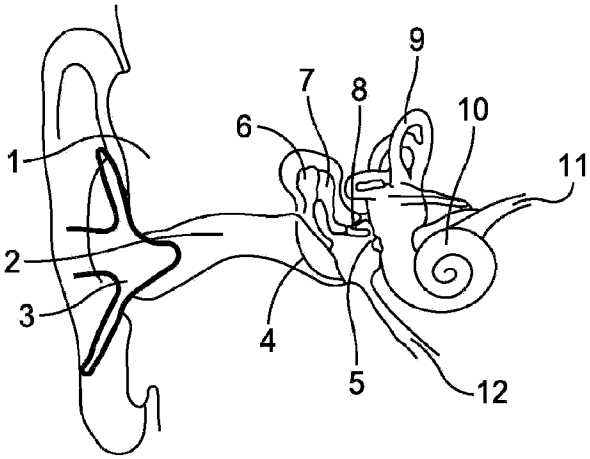

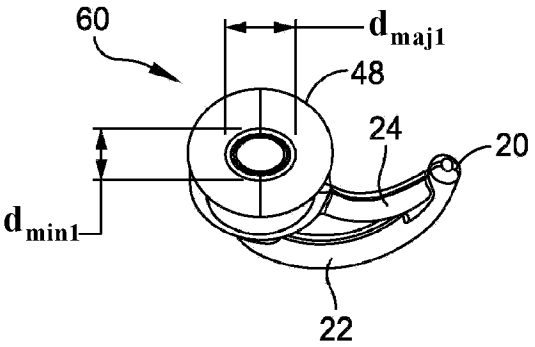
FIG. 7A
FIG. 7B
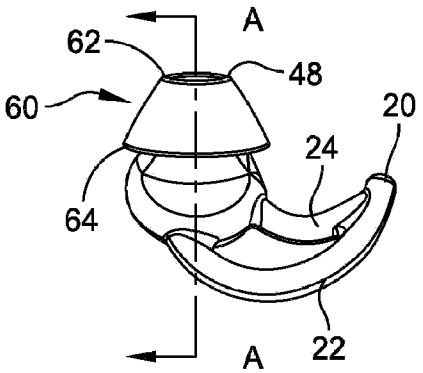
FIG. 7C
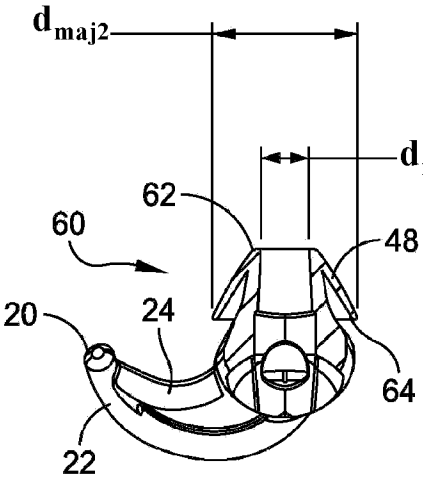
SECTION B-B
FIG. 8A
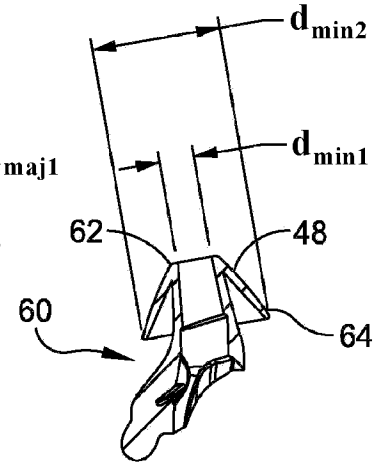
SECTION A-A
FIG. 8B

EARPIECE TIP AND RELATED EARPIECE

TECHNICAL FIELD

This disclosure generally relates to audio devices. More particularly, the disclosure relates to an earpiece tip and related earpiece for an earphone system which may be used to fit distinct ear shapes.

BACKGROUND

Portable electronic devices, including headphone and other wearable audio systems are becoming more commonplace. However, particularly when integrated into an active user's lifestyle, these devices must delicately balance comfort against stability. For some form factors, such as earphone-type headphones, balancing comfort and stability can be particularly challenging.

SUMMARY

All examples and features mentioned below can be combined in any technically possible way.

Various implementations include an eartip for an earphone earpiece. The eartip can be configured to reliably fit a plurality of ear shapes. The eartip can have a body and a sealing structure defined by a set of dimensions that are configured to seal the ear canal of one or more users.

In some particular implementations, an eartip is configured to couple with an electronics module on an earphone earpiece. The eartip can include: a body for coupling with the electronics module; and a sealing structure coupled with the body, the sealing structure having a substantially conical shape for conforming to an entrance of an ear canal of a user, where the sealing structure is defined by a cone-shaped wall having a smaller end and a larger end, where a shape of the sealing structure is defined by dimensions including: (a) a perimeter of a first opening at the smaller end; (b) a perimeter of a second opening at the larger end; (c) a thickness of the cone-shaped wall; and (d) a distance between the smaller end and the larger end as measured along a primary axis of the sealing structure, and where dimensions (a), (b) and (d) have a ratio relative to the thickness of the cone-shaped wall (c) of approximately: (a) 13:1 to 14:1; (b) 56:1 to 62:1; and (d) 7.5:1 to 8.5:1.

In other particular implementations, an earphone earpiece includes: an electronics module including a mount; and an eartip coupled with the electronics module at the mount, the eartip having: a body including a passageway coupled with the mount on the electronics module; and a sealing structure coupled with the body, the sealing structure having a substantially conical shape for conforming to an entrance of an ear canal of a user, where the sealing structure is defined by a cone-shaped wall having a smaller end and a larger end, where a shape of the sealing structure is defined by dimensions including: (a) a perimeter of a first opening at the smaller end; (b) a perimeter of a second opening at the larger end; (c) a thickness of the cone-shaped wall; (d) a taper angle of the cone-shaped wall between the first opening and the second opening; and (e) a distance between the smaller end and the larger end as measured along a primary axis of the sealing structure, and where dimensions (a), (b) and (d) have a ratio relative to the thickness of the cone-shaped wall (c) of approximately: (a) 13:1 to 14:1; (b) 56:1 to 62:1; and (d) 7.5:1 to 8.5:1.

In additional particular implementations, an eartip is configured to couple with an electronics module on an earphone earpiece. The eartip can include: a body including a passageway for matingly coupling with a mount on the electronics module, the passageway including a notch along an inner surface thereof; and a sealing structure coupled with the body, the sealing structure including a substantially conical shape for conforming to an entrance of an ear canal of a user, where the sealing structure is defined by a cone-shaped wall having a smaller end and a larger end, where a shape of the sealing structure is defined by dimensions including: (a) a perimeter of a first opening at the smaller end; (b) a perimeter of a second opening at the larger end; (c) a thickness of the cone-shaped wall; and (d) a distance between the smaller end and the larger end as measured along a primary axis of the sealing structure, where the notch in the body permits flexion of the body during coupling or decoupling of the body from the mount and provides sufficient hoop stress around the mount to retain the eartip on the mount during use of the earphone earpiece.

Implementations may include one of the following features, or any combination thereof.

In particular cases, the size of the first opening at the smaller end and the size of the second opening at the larger end each include a minor dimension and a major dimension, where the minor dimension of the first opening is less than or equal to the major dimension of the first opening, and the minor dimension of the second opening is less than or equal to the major dimension of the second opening. In some aspects, a ratio of the minor dimension of the first opening to the major dimension of the first opening is equal to approximately: 0.62-0.72, and a ratio of the minor dimension of the second opening to the major dimension of the second opening is equal to approximately: 0.90 to 1.0.

In certain aspects, dimensions (a) and (b) have a ratio of approximately: 0.18 to approximately 0.28.

In certain cases, dimensions (c) and (d) have a ratio of approximately: 0.10 to approximately 0.15.

In some aspects, the body further includes a passageway for matingly engaging a mount on the electronics module, the passageway having a notch along an inner surface thereof. In particular cases, the notch permits flexion of the body during coupling or decoupling of the body from the mount and provides sufficient hoop stress around the mount to retain the eartip on the mount during use of the earphone earpiece. In certain implementations, the hoop stress is equal to approximately: 1-5 kilograms.

In some cases, the thickness of the cone-shaped wall (c) is approximately 0.9 to approximately 1.1 millimeters (mm).

In particular aspects, the shape of the sealing structure is further defined by an additional dimension including: (e) a taper angle of the cone-shaped wall between the first opening and the second opening, where the taper angle is equal to approximately 25 degrees to approximately 35 degrees. In some implementations, the ratio of dimensions (a), (b), (c) and (d), and the taper angle (e), yield a defined set of best-fit shapes for a statistically representative group of ear canal shapes, wherein the defined set comprises approximately 5-10 best-fit shapes.

Two or more features described in this disclosure, including those described in this summary section, may be combined to form implementations not specifically described herein.

The details of one or more implementations are set forth in the accompanying drawings and the description below.

Other features, objects and advantages will be apparent from the description and drawings, and from the claims.

BRIEF DESCRIPTION OF THE DRAWINGS

FIG. 4 shows cross-sections of two example human ears.

FIG. 6 shows cross-sections of two example human ears.

FIGS. 7A-7C are views of a portion of the earpiece of FIGS. 2 and 5A-5D.

FIGS. 8A and 8B are cross-sections of the earpiece portions of FIGS. 7A-7C.

Figure 1A:
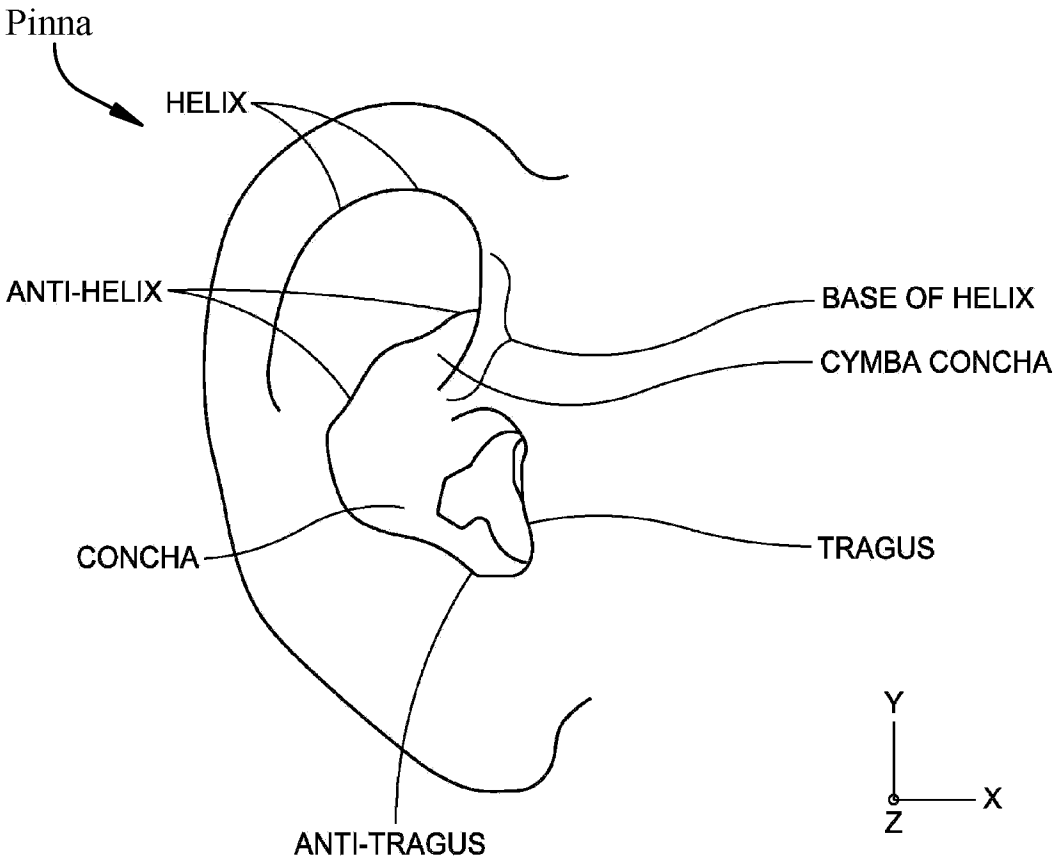
FIG. 1A shows the lateral surface of a human right ear, with some features identified.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that an earphone system can benefit from an eartip and related earpiece with a shape configured to fit a plurality of ear types. For example, the earphone system can include an eartip that is configured to substantially seal the entrance of a user's ear canal to improve conversation enhancement functions. Additionally, the disclosure is based, at least in part, on the realization that an earphone system can benefit from an eartip that includes a notch within its body. The notch can be used to enhance coupling and decoupling of the body from a mount on the earphone's electronics module, e.g., by permitting flexion of the body and sufficient hoop stress to retain the eartip once located on the mount.

Commonly labeled components in the FIGURES are considered to be substantially equivalent components for the purposes of illustration, and redundant discussion of those components is omitted for clarity.

Figure 1B:
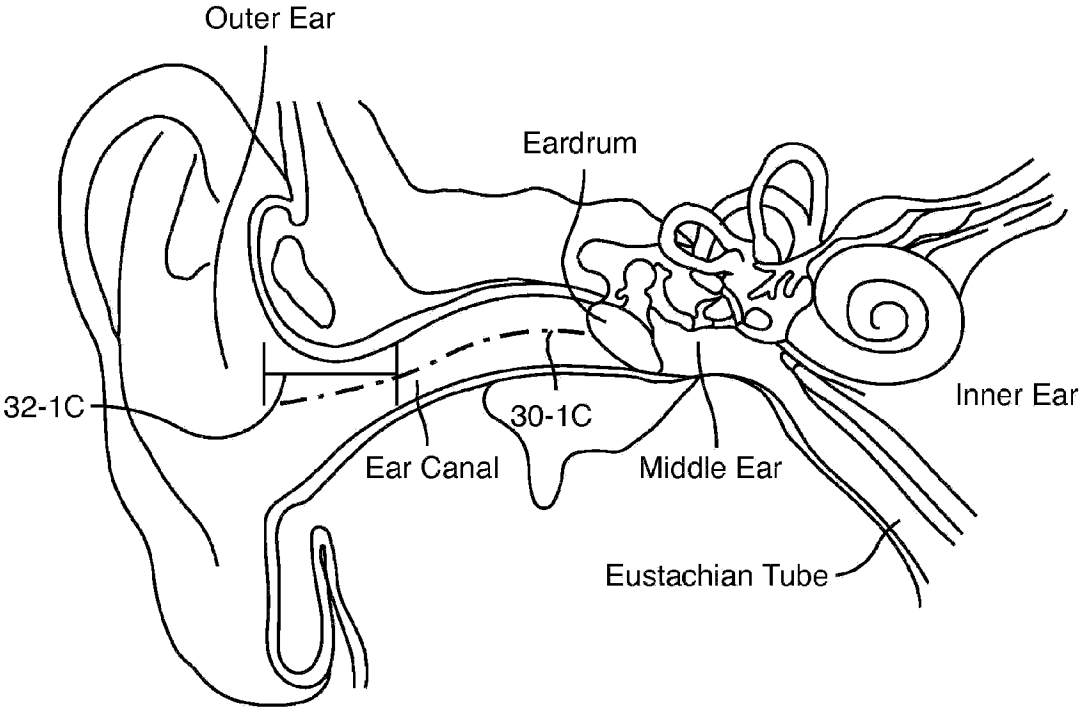
FIG. 1B shows an example cross-section of the human ear, with some features identified.
Figure 5B:
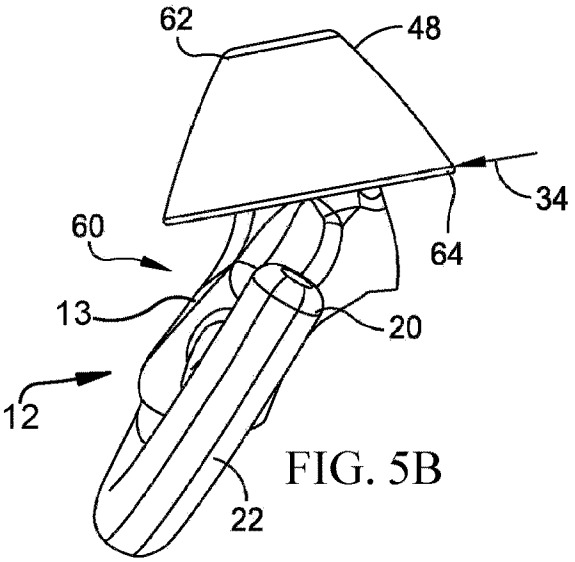
FIGS. 5A-5D are views of an earpiece according to various implementations.
Figure 5D:
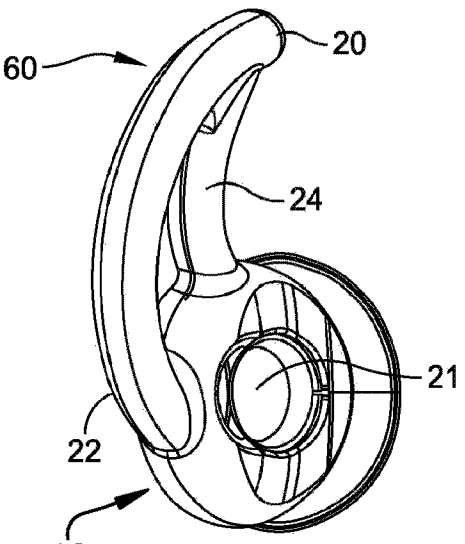
Figure 5A:
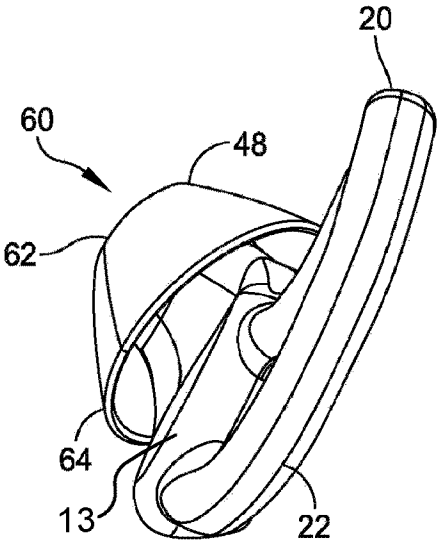
Figure 5C:
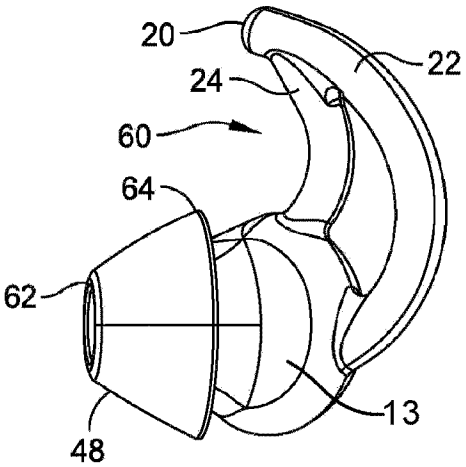

FIG. 1A shows the lateral surface of a human right ear, with some features identified. Ears will have different sizes and shapes from individual to individual. Some ears have additional anatomical features that are not shown in FIG. 1A. Some ears lack some of the features that are shown in FIG. 1A. Some features may be more or less prominent than are shown in FIG. 1A. FIG. 1B shows an example cross-section of the human ear, with some features identified. The ear canal is an irregularly shaped cylinder with a variable cross sectional area and a centerline that is not straight. Among the features identified is the entrance to the ear canal and the main portion of the ear canal. In this specification, the entrance to the ear canal refers to the portion of the ear canal near the concha where the walls of the ear canal are substantially non parallel to the centerline of the ear canal. The precise structure of the human ear and its various anatomical features will vary widely from individual to individual. For example, in the cross-second of FIG. 1B, there is a gradual transition from walls that are non-parallel to a centerline of the ear canal to walls that are substantially parallel to a centerline 30-1C of the ear canal, so the entrance 32-1C to the ear canal is relatively long.

As used herein, the "pinna" of the ear can refer to the outer ear, or the portion of the ear that is external to the body and excludes the ear canal. In various implementations, components will be described relative to the pinna of the ear, e.g., over the top of the pinna. In some cases, these components can fit over a portion of the pinna, e.g., the top, in the space between the back of the outer ear and the head.

For those who employ headphones or headset forms of personal audio devices to listen to electronically provided audio, it is commonplace for that audio to be provided with at least two audio channels (e.g., stereo audio with left and right channels) to be separately acoustically output with separate earpieces to each ear. For those simply seeking to be acoustically isolated from unwanted or possibly harmful sounds, it has become commonplace for acoustic isolation to be achieved through the use of active noise reduction (ANR) techniques based on the acoustic output of anti-noise sounds in addition to passive noise reduction (PNR) techniques based on sound absorbing and/or reflecting materials. Further, it is commonplace to combine ANR with other audio functions in headphones.

Aspects and implementations disclosed herein may be applicable to earphone systems that either do or do not support two-way communications, and either do or do not support active noise reduction (ANR). For earphone systems that do support either two-way communications or ANR, it is intended that various implementations disclosed and claimed herein are applicable to an earphone system incorporating one or more microphones disposed on a portion of the personal audio device that remains outside an ear when in use (e.g., feedforward microphones), on a portion that is inserted into a portion of an ear when in use (e.g., feedback microphones), or disposed on both of such portions. Still other implementations of earphone systems to which what is disclosed and what is claimed herein is applicable will be apparent to those skilled in the art.

Figure 2:
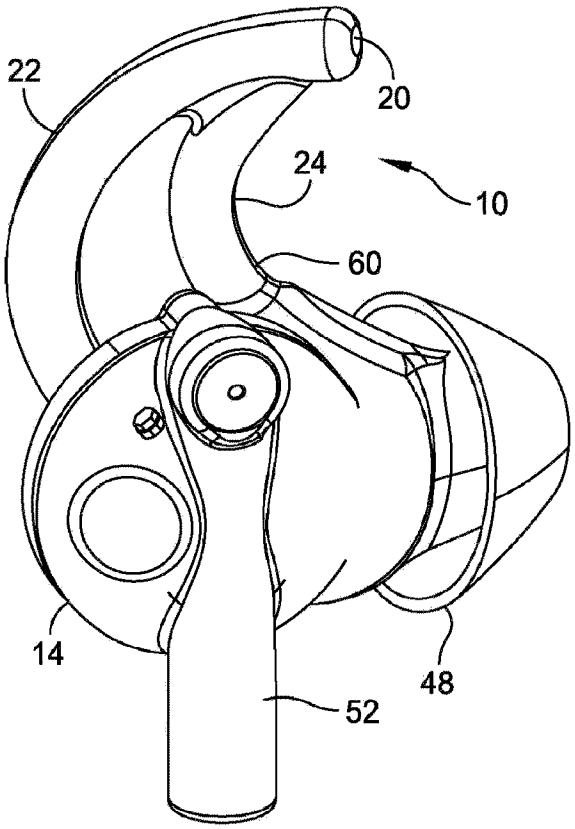
FIG. 2 is an isometric view of an earpiece according to various implementations.

FIG. 2 is a schematic depiction of an earphone earpiece 10, which may be part of a set of earphones (e.g., two earpieces) in an earphone system (not shown). Additional aspects of an earphone system that can be configured to utilize the earpiece 10 are described in U.S. patent application Ser. No. 16/118,739, filed concurrently on Aug. 31, 2018, as well as U.S. Pat. No. 8,737,669, both of which are incorporated here by reference.

Each earphone earpiece (or simply, earpiece) 10 can be configured to position in respective ears of a user (e.g., where a right earphone is oriented to fit a right ear and a left earphone is oriented to fit a left ear). The earpiece 10 may include a stem 52 for positioning cabling and the like, an electronics module (which can include an acoustic driver modulel 14, and a tip 60 (more clearly identified in FIGS. 5A-5D). Some earpieces may include a stem (e.g., similar to stem 52) that is positioned in a different location and/or orientation, such as in the case of over-pinna mounted earphone systems. Some earpieces may lack the stem 52 but may include electronics modules (not shown) for wireless communicating with external devices. Other earpieces may lack the stem and the electronics module and may function as passive earplugs. The tip 60 includes a positioning and retaining structure 20, which in this example includes an outer leg 22 and an inner leg 24. The tip 60 also includes a sealing structure 48.

In operation, the earpiece 10 is placed in the ear and is oriented and held in place by positioning and retaining structure 20 and other portions of the earpiece 10. The tip 60 includes a body 12 which in turn includes a passageway 18 to conduct sound waves radiated by an acoustic driver in the electronics module 14 to the ear canal. The body 12 can have a substantially planar surface 13 that substantially rests against the concha at one end. Extending from the tip 60 is the positioning and retaining structure 20 that holds the earpiece 10 in position, in some cases without significant contribution from the portions of the earpiece 10 that engage the ear canal and without any structure external to the earpiece 10. The positioning and retaining structure 20 can include at least an outer leg 22 and an inner leg 24 that are joined to other portions of the earpiece 10 at one end and are joined to each other at the other end. The outer leg 22 can be curved to generally follow the curve of the anti-helix and/or the cymba concha at the rear of the concha. In general, the compliance/stiffness of the entire positioning and retaining structure 20 is more important than the compliance/stiffness of the material from which the positioning and retaining structure 20 is made or the compliance/stiffness of the any one component of the positioning and retaining structure. The outer leg 22 and inner leg 24 may lie in a plane.

Figure 3:
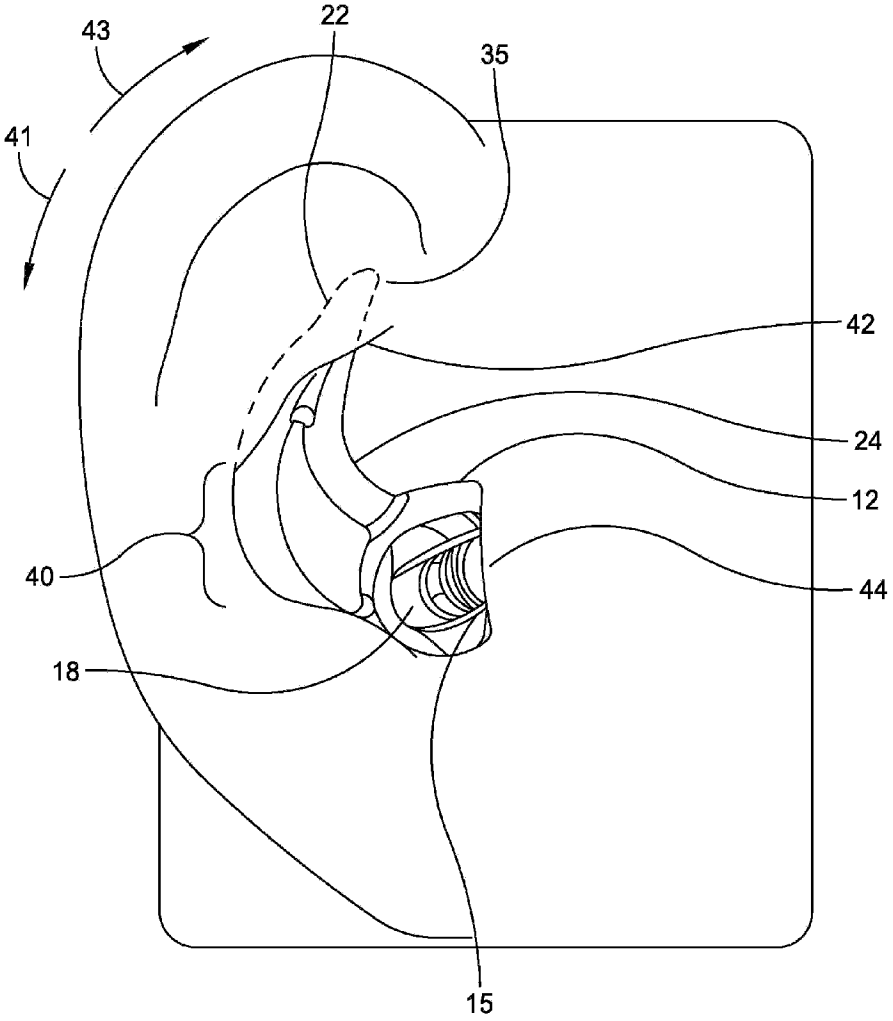
FIG. 3 is a lateral view of an earpiece and a human ear according to various implementations.

Referring now to FIG. 3, in some cases, the tip 60 (partially obstructed in this view) of the earpiece 10 is placed in the ear and pushed gently inward and preferably rotated counter-clockwise as indicated by arrow 41. Pushing the body 12 into the ear causes the outer leg 22 to seat in position underneath the anti-helix, and causes the sealing structure 48 of the tip (obstructed in this view) to enter the ear canal by a small amount, depending on the dimensions and geometry of the entrance to the ear canal.

In certain cases, the body 12 is then rotated clockwise as indicated by arrow 43 until a condition occurs so that the body 12 cannot be further rotated. The conditions could include: the extremity 35 of the tip 60 may contact the base of the helix; inner leg 24 may contact the base of the helix; or the extremity 35 may become wedged behind the anti-helix in the cymba concha region. Though the positioning and retaining structure 20 provides all three conditions (hereinafter referred to as "modes)", not all three conditions will happen for all users, but at least one of the modes will occur for most users. Which condition(s) occur(s) is dependent on the size and geometry of the user's ears, and as discussed herein, the fit of the sealing structure 48 against the opening of the user's ear canal.

Rotating the earpiece 10 clockwise also causes the extremity 35 and outer leg 22 to engage the cymba concha region and seat beneath the anti-helix. When the body 12 and positioning and retaining structure 20 are in place, the positioning and retaining structure 20 and/or body 12 contact the ear of most people in at least two, and in many people more, of several ways: a length 40 of the outer leg 22 contacts the anti-helix at the rear of the concha; the extremity 35 of the positioning and retaining structure 20 is underneath the anti-helix; portions of the outer leg 22 or tip 60 (of previous figures) or both are underneath the anti-tragus; and/or the tip 60 contacts at the entrance to the ear canal under the tragus. In some cases, the two or more points of contact hold the earpiece in position, providing greater stability. In these cases, the distributing of the force, and the compliance of the portions of the body and the outer leg that contact the ear lessens pressure on the ear, providing a more comfortable fit.

It may be desirable to place the earpiece in the ear so that it is oriented properly, so that it is stable (that is, stays in the ear), so that it is comfortable, and, for some applications so that it provides significant passive attenuation of ambient noise. One way of providing stability and proper orientation is described above and is described more completely in U.S. Pat. No. 8,249,287, incorporated here by reference in its entirety.

One apparatus for providing significant passive attenuation is a structure (for example a "Christmas tree" structure, as described in U.S. Pat. App. No. 2004/0163653, a "mushroom" structure, as described by U.S. Pat. No. 5,957,136, or disk shaped flanges, such as described in U.S. Pat. No. 6,129,175, or similar structures) that fit in the main portion of the ear canal and seals to the ear canal itself by exerting radial pressure on the walls of the main portion of the ear canal, as indicated by arrows 70, 72, and 74 of FIG. 4. The radial pressure may result from, or be supplemented by, inward clamping pressure. This apparatus may have some undesirable side effects, such as poor sealing, discomfort, or even pain, because the geometry and size of ear canals vary widely from individual to individual and because the apparatus may intrude farther into the ear canal than desired in some individuals. The main portion of the ear canal, particularly close to the middle ear, is very sensitive, so the farther the structure extends into the ear, the more uncomfortable it is likely to be. Another apparatus for providing significant passive attenuation is structure, apart from the earpiece itself, which provides inward clamping pressure that urges a conformable structure against the side of the head or the side of the ear. Examples include headbands of conventional headphones and yokes of stethoscopes, for example as described in U.S. Pat. No. 4,055,233. However, for in-the-ear earpieces, light weight and small size are desirable features, and headbands and yokes add weight and structure.

Figure 9:
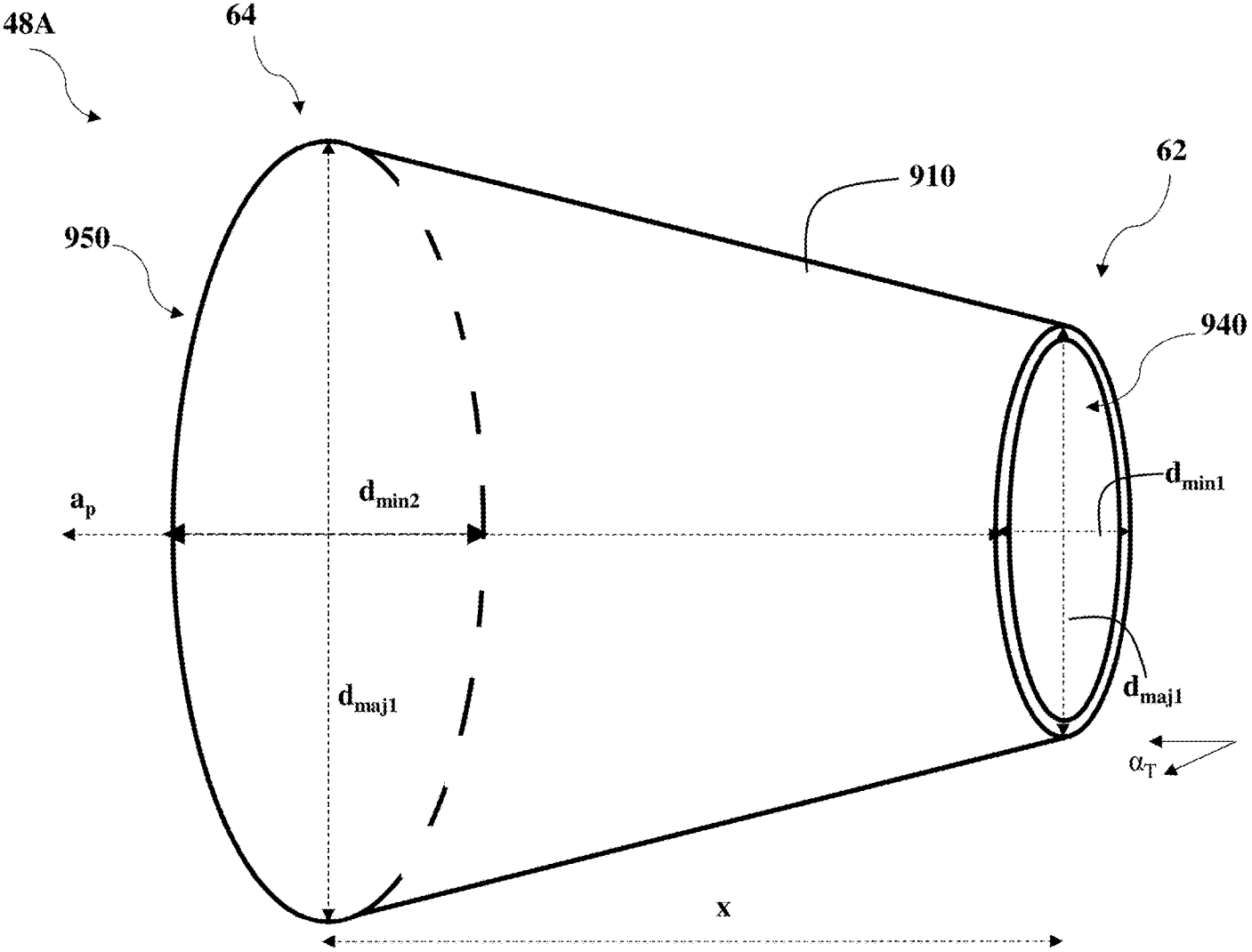
FIG. 9 shows a side perspective view of a sealing structure according to various implementations.
Figure 10:
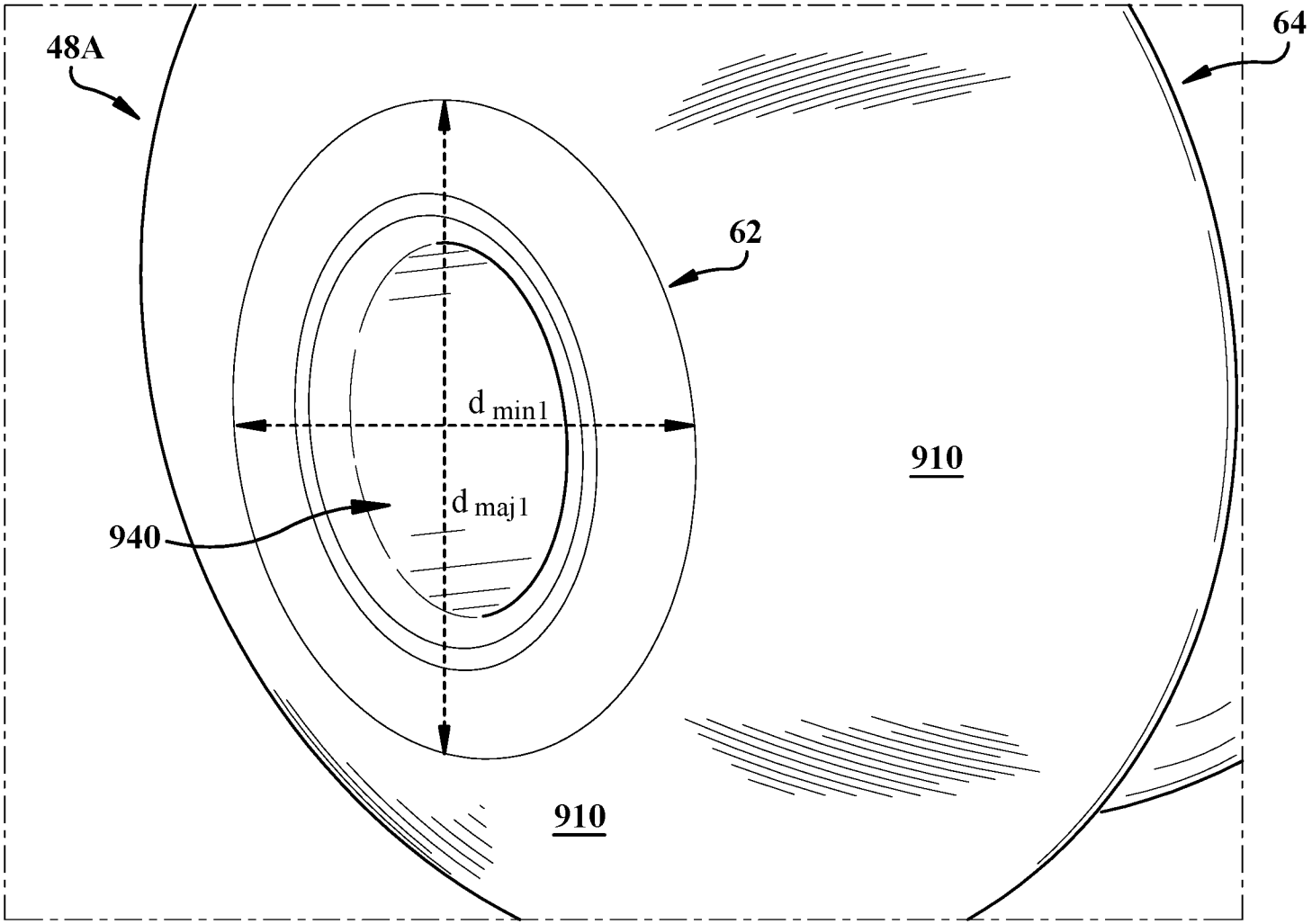
FIG. 10 shows a front perspective view of the sealing structure of FIG. 9.

In some particular implementations, the earphone system including earpiece 10 (FIG. 2), or other earpieces shown and described herein, can include a conversation enhancing headphone system. That is, the earphone system employing earpiece 10 (e.g., a pair of earpieces 10) can be controllable to modify audio playback, for example, by adjusting characteristics of environmental (or "world") sound and tuning particular audio characteristics (e.g., treble and bass) to enhance the user experience. This earphone system can rely upon ANR processes in order to provide this enhanced audio playback to the user. Sealing the ear canal with the sealing structure 48 (and/or sealing structure 48A in FIGS. 9 and 10) on the tip 60 can be particularly beneficial when providing conversation enhancing functions such as ANR. That is, if the ear canal is not properly sealed by the sealing structure 48, feedforward microphone(s) can capture audio playback escaping the ear canal and create unwanted feedback or "whistling." This phenomenon is sometimes experienced by users of conventional hearing aids, and significantly diminishes the user experience.

The eartip 10 in FIG. 2 can provide for enhanced sealing of the ear canal when compared with conventional eartip configurations, for example, by use of the sealing structure 48. In addition to providing orientation and stability control, the eartip 10 can effectively seal the entrance to the ear canal and the ear structure outside the ear canal, without excessive radial pressure, and without inward clamping pressure provided by a source not included in the earpiece.

In some particular implementations, the eartip 10 can be beneficially incorporated into a set of eartips provided with an earphone system, e.g., to provide adjustable fit options to a user. In these cases, it can be particularly challenging to fit eartips for users with larger than average ear canals or irregular canal and/or concha shapes. As such, conventional eartips may fail to adequately seal the ear canal for these users. Failure to adequately seal the ear canal can significantly diminish the user experience, and render conversation enhancing functions impracticable. As described herein, the eartip 10 according to various implementations can improve sealing of the ear canal when compared with conventional eartips, and may be particularly beneficial for irregular and/or larger ear sizes.

FIGS. 5A-5D shows several views of the tip 60. Not all elements of the tip 60 are identified in all of the views. The tip 60 includes positioning and retaining structure 20, a passageway 21, and sealing structure 48. The sealing structure 48 comprises a frusto-conical structure. In some cases, the frusto-conical structure may have an elliptical or oval cross-section (as viewed in FIG. 7A), with walls that taper substantially linearly (as viewed in FIGS. 7B, 8A and 8B). However, other cross-sections (e.g., approximately circular cross-section) are also possible. Examples of appropriate materials for the sealing structure 48 include silicones, TPUs (thermoplastic polyurethanes) and TPEs (thermoplastic elastomers).

With continuing reference to FIGS. 5A-5D, the smaller end 62 of the tip 60 is dimensioned so that it fits inside the ear canal of most users by a small amount and so that the sealing structure 48 contacts the entrance to the ear canal but does not contact the inside of the ear canal. The larger end 64 of the tip 60 is dimensioned so that it is larger than the entrance to the ear canal of most users.

The positioning and retaining structure 20 and the sealing structure 48 may be a single piece, made of the same material, for example a very soft silicone rubber (e.g., with a hardness of 30 Shore A or less). However, the positioning and retaining structure 20 can also be formed of distinct pieces that mate, are coupled, or otherwise overlap to mount on the electronics module 14. In some cases, the walls of the sealing structure 48 may be of a uniform thickness which may be very thin, for example, less than one millimeter (mm) at the thickest part of the wall and may taper to the base of the frusto-conical structure so that the walls deflect easily, thereby conforming easily to the contours of the ear and providing a good seal and good passive attenuation without exerting significant radial pressure on the ear canal. In other cases, the walls of the sealing structure 48 can have a non-uniform thickness. Since the different parts of the earpiece 10 serve different functions, it may be desirable for different portions of the earpiece to be made of different materials, or materials with different hardnesses or moduli. For example, hardness (durometer) of the positioning and retaining structure 20 may be selected for comfort (for example, with a hardness of 12 Shore A), the hardness of the sealing structure 48 may be slightly higher (for example, 20 Shore A) for better fit and seal, and the hardness of the body 12 of the eartip 10 that mechanically couples the eartip to the electronics module 14 (i.e., surrounding passageway 21) may be higher (for example, 70 Shore A) for better retention and seal around the passageway 21, and in some instances so that the passage through which sound waves travel has a more consistent shape and dimensions.

An eartip such as eartip 10 shown in FIGS. 5A-5D seals the entrance of the ear canal to provide passive attenuation and exerts little radial pressure against the main portion of the ear canal, or does not contact the main portion of the ear canal at all, as shown in FIG. 6.

FIGS. 7A-7C show external views and FIGS. 8A and 8B show cross-sectional views, of the tip 60 according to various implementations. In the implementations of FIGS. 7A-7C and 8A and 8B, the sealing structure 48 is elliptical, with a major dimension (or axis) ($d_{maj}$) and a minor dimension (or axis) ($d_{min}$) at the smaller end 62, and a major dimension and a minor dimension at the larger end 64. A sealing structure with these dimensions fits into the ear canal of many users so that the smaller end protrudes into the ear canal by a small amount and does not contact the walls of the ear canal, so that the larger end does not fit in the ear canal, and so that the sealing structure 48 engages the entrance to the ear canal. Smaller or larger versions may be used for users with below- or above-average-sized ear, including children. Versions with similar overall size but different aspect ratios between major and minor axes may be provided for users with ear canal entrances that are more- or less-circular than average.

In particular cases, a sealing structure may be beneficially designed for users having irregular ear shapes and/or larger than average ear canal dimensions. Various implementations address these design constraints, and can provide for selectable sizing options For example, as shown in the side perspective view of FIG. 9, the front perspective view of FIG. 10, the cross-sectional view of FIG. 11, and the front view of FIG. 12, according to various implementations, a sealing structure 48A is defined by a cone-shaped wall 910 having the smaller end 62 and a larger end 64 (similar to sealing structure 48 shown and describe with reference to FIGS. 5A-5D, 7A-7C, 8A and 8B), where a shape of the sealing structure 48A is defined by dimensions including:

(a) a size (i.e., perimeter) of a first opening 940 at the smaller end 62 (e.g., in terms of major dimension and minor dimension);

(b) a size (i.e., perimeter) of a second opening 950 at the larger end 64 (e.g., in terms of major dimension and minor dimension);

(c) a thickness ($t_w$) of the cone-shaped wall 910 (which may vary slightly from smaller end 62 to larger end); and (d) a distance (x) between the smaller end 62 and the larger end 64 as measured along the primary axis ($a_p$) of the sealing structure 48A.

As used herein, the perimeter of the first opening 940 and second opening 950 can be measured, respectively, around the outer surface of the cone-shaped wall 910 at the narrowest point (around first opening 940) and the widest point (around second opening 950).

In various implementations, dimensions (a), (b) and (d) have a ratio relative to the thickness ($t_w$) of the cone-shaped wall 910 (dimension (c)) of approximately: (a) 13:1 to 14:1; (b) 56:1 to 62:1; and (d) 7.5:1 to 8.5:1. In some particular implementations, the thickness of the cone-shaped wall (c) is approximately 0.9 to approximately 1.1 millimeters (mm) In these cases, ratios of dimensions (a), (b) and (d) can be scaled according to this range of values for (c).

In some particular implementations, dimensions (a) and (b) have a ratio of approximately: 0.18 to approximately 0.28 (in particular cases, approximately 0.23). In these implementations or additional particular implementations, dimensions (c) and (d) have a ratio of approximately: 0.10 to approximately 0.15 (in particular cases, approximately 0.125).

In particular cases, the size of the first opening 940 and the size of the second opening 950 each include a minor dimension (drain) and a major dimension ($d_{maj}$), where the minor dimension ($d_{min1}$) of the first opening 940 is less than or equal to the major dimension ($d_{maj1}$) of the first opening 940, and the minor dimension ($d_{min2}$) of the second opening 950 is less than or equal to the major dimension ($d_{maj2}$) of the second opening 950. In some aspects, a ratio of the minor dimension ($d_{min1}$) of the first opening 940 to the major dimension ($d_{maj1}$) of the first opening 940 is equal to approximately: 0.62-0.72 (in some particular cases approximately 0.67), and a ratio of the minor dimension ($d_{min2}$) of the second opening 950 to the major dimension ($d_{maj2}$) of the second opening 950 is equal to approximately: 0.9 to 1.0 (in some particular cases, approximately 0.95).

In additional implementations, the shape of the sealing structure 48A is further defined by an additional dimension: (e) a taper angle ($\alpha_T$) of the cone-shaped wall 910 between the first opening 940 and the second opening 950 (e.g., as measured from the horizontal plane, or a plane parallel with the primary axis ($\alpha_p$) of the sealing structure 48A). In particular implementations, the taper angle ($\alpha_T$) is equal to approximately 25 degrees to approximately 35 degrees.

In various implementations, the ratio of dimensions (a), (b), (c) and (d), along with the taper angle ($\alpha_T$) (dimension (e)) yield a defined set of best-fit shapes for a statistically representative group of ear canal shapes, wherein the defined set comprises approximately 5-10 best-fit shapes. The statistically representative group of ear canal shapes can be determined using general population data, which is cross-referenced with user feedback and additionally refined with acoustic feedback tests to determine design acceptability for a significant portion of the general population.

In one example implementation, general population data about ear canal shapes (e.g., as available from, "Anthropometric Analysis of 3D Ear Scans of Koreans and Caucasians for Ear Product Design," published in The Official Journal of the Chartered Institute of Ergonomics and Human Factors, vol. 6, no. 8, incorporated herein by reference) was used to build a set of sealing structures having dimensions, e.g., as measured with reference to sealing structure 48A. These sealing structures were then provided to human users for use under various conditions, and feedback was gathered to qualify attributes of particular dimensions of the sealing structures. Additionally, acoustic testing was performed on the set of sealing structures to determine effectiveness in sealing for a subset of the general population of ear canal shapes, in particular, for larger-than-average and/or irregular ear canal shapes. The user feedback data and acoustic testing data was used to generate a plurality (e.g., 5-10) best-fit shapes for this subset of the general population.

Figure 11:
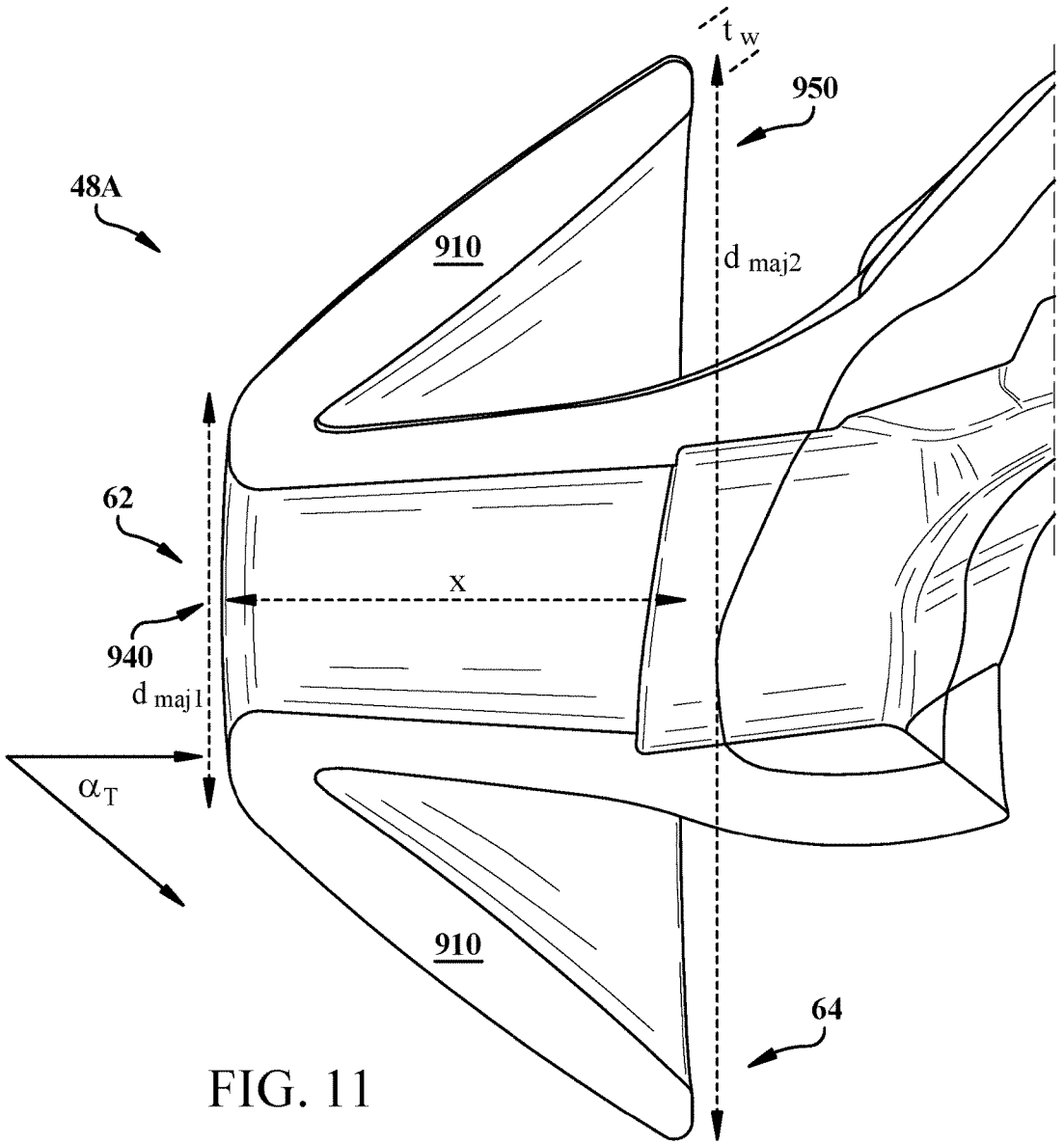
FIG. 11 shows a cross-section of the sealing structure of FIG. 9, including features of the earpiece, according to various implementations.
Figure 12:
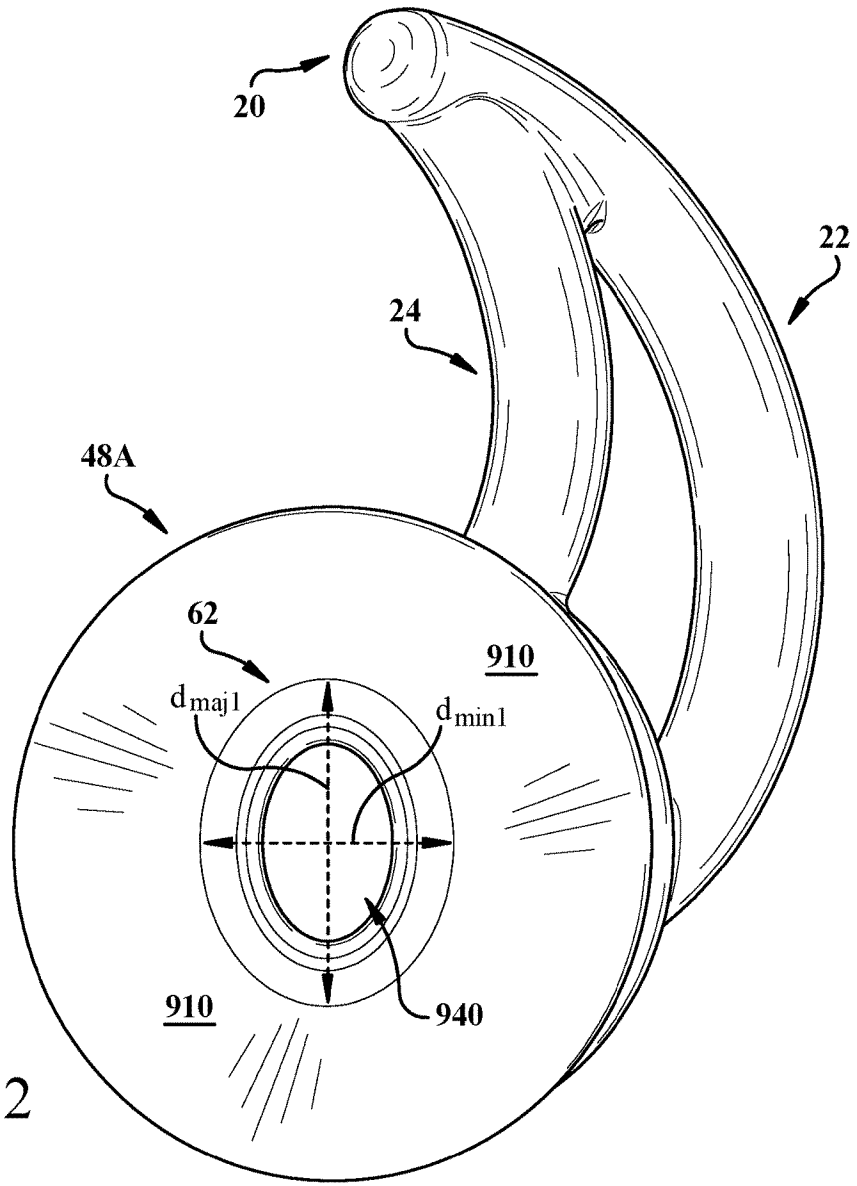
FIG. 12 shows a portion of the earpiece of FIG. 12.
Figure 13:
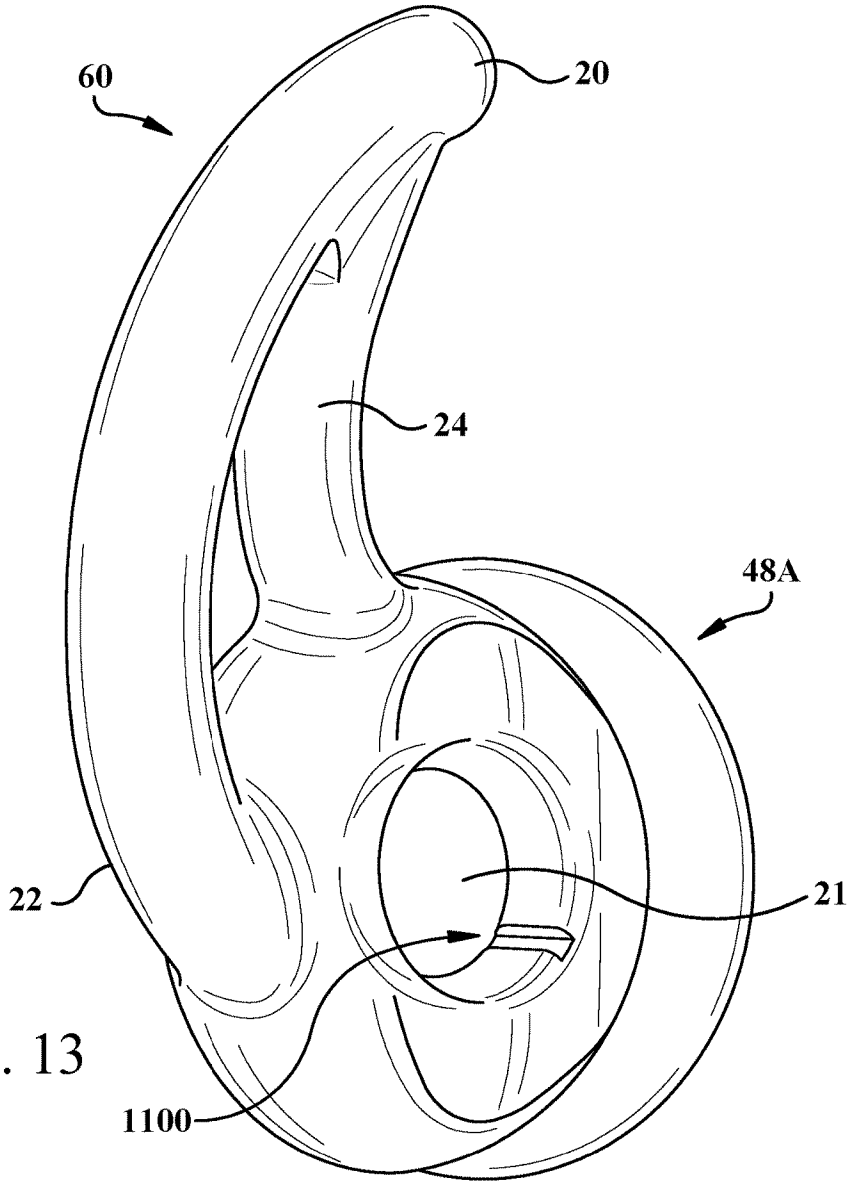
FIG. 13 shows a perspective view of an eartip including a notch in the body according to various implementations.

In some implementations (or integral with any implementation described herein), as shown in FIG. 11, the body 12 of the eartip 60 can additionally include a notch 1100 (or a plurality of notches), located in the passageway 21 that is configured to engage the mount on the electronics module 14 (shown in FIG. 2). That is, the body 12 can include the notch 1100 along an inner surface of the passageway 21. In some cases, the notch 1100 can extend entirely axially through the passageway 21, separating portions of the body 12 at the surface of the passageway 21. With continuing reference to FIG. 11, along with reference to FIG. 2, in some implementations, the notch 1100 permits flexion of the body 12 during coupling or decoupling of the body 12 from the mount on the electronics module 14. In addition, the notch 1100 can provide sufficient hoop stress around that mount to retain the eartip 60 on the mount during use of the earpiece utilizing the eartip 60. In some particular implementations, the hoop stress is equal to approximately 1 kilogram (kg) to approximately 5 kg.

In various implementations, the eartips shown and described herein can aid in effectively sealing the ear canal of a user to enable conversation-enhancing functions. In some particular implementations, these eartip dimensions can enhance the fitting process for users with larger-than-average and/or irregular ear shapes. In some cases, where conventional earphone systems provide a user with pre-defined eartip fit options (e.g., small, medium, large), the eartips shown and described herein can function as extra-large (XL) or XL-plus fits that accommodate users who find the conventional large eartip fits uncomfortably or without sufficiently sealing their ear canal.

The eartips shown and described herein may be particularly useful in over-the-pinna earphone configurations, such as those headphone systems utilizing an arm that extends over the pinna of the user. Such earphone designs are described in U.S. patent application Ser. No. 16/118,739, filed concurrently on Aug. 31, 2018. These eartips may aid in sealing the ear canal of a user of such an earphone, and as noted herein, may be particularly useful in conversation-enhancing earphone systems.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other embodiments are within the scope of the following claims.

We claim:

1. An eartip configured to couple with an electronics module on an earphone earpiece, the eartip comprising:

a body for coupling with the electronics module; and a sealing structure coupled with the body, the sealing structure comprising a substantially conical shape for conforming to an entrance of an ear canal of a user, wherein the sealing structure is defined by a cone-shaped wall having a smaller end and a larger end, wherein a shape of the sealing structure is defined by dimensions comprising:

(a) a perimeter of a first opening at the smaller end;

(b) a perimeter of a second opening at the larger end;

(c) a thickness of the cone-shaped wall; and (d) a distance between the smaller end and the larger end as measured along a primary axis of the sealing structure, and wherein dimensions (a), (b) and (d) have a ratio relative to the thickness of the cone-shaped wall (c) of approximately: (a) 13:1 to 14:1; (b) 56:1 to 62:1; and (d) 7.5:1 to 8.5:1.

2. The eartip of claim 1, wherein the size of the first opening at the smaller end and the size of the second opening at the larger end each comprise a minor dimension and a major dimension, wherein the minor dimension of the first opening is less than or equal to the major dimension of the first opening, and wherein the minor dimension of the second opening is less than or equal to the major dimension of the second opening.

3. The eartip of claim 2, wherein a ratio of the minor dimension of the first opening to the major dimension of the first opening is equal to approximately: 0.62-0.72, and wherein a ratio of the minor dimension of the second opening to the major dimension of the second opening is equal to approximately: 0.90 to 1.0.

4. The eartip of claim 1, wherein dimensions (a) and (b) have a ratio of approximately: 0.18 to approximately 0.28.

5. The eartip of claim 1, wherein dimensions (c) and (d) have a ratio of approximately: 0.10 to approximately 0.15.

6. The eartip of claim 1, wherein the body further comprises a passageway for matingly engaging a mount on the electronics module, the passageway comprising a notch along an inner surface thereof.

7. The eartip of claim 6, wherein the notch permits flexion of the body during coupling or decoupling of the body from the mount and provides sufficient hoop stress around the mount to retain the eartip on the mount during use of the earphone earpiece, wherein the hoop stress is equal to approximately 1 kilogram (kg) to approximately 5 kg.

8. The eartip of claim 1, wherein the shape of the sealing structure is further defined by an additional dimension comprising: (e) a taper angle of the cone-shaped wall between the first opening and the second opening, wherein the taper angle is equal to approximately 25 degrees to approximately 35 degrees.

9. The eartip of claim 8, wherein the ratio of dimensions (a), (b), (c) and (d), and the taper angle (e), yield a defined set of best-fit shapes for a statistically representative group of ear canal shapes, wherein the defined set comprises approximately 5-10 best-fit shapes.

10. An earphone earpiece, comprising:

an electronics module comprising a mount; and an eartip coupled with the electronics module at the mount, the eartip comprising a body comprising a passageway coupled with the mount on the electronics module; and a sealing structure coupled with the body, the sealing structure comprising a substantially conical shape for conforming to an entrance of an ear canal of a user, wherein the sealing structure is defined by a cone-shaped wall having a smaller end and a larger end, wherein a shape of the sealing structure is defined by dimensions comprising:

(a) a perimeter of a first opening at the smaller end;

(b) a perimeter of a second opening at the larger end;

(c) a thickness of the cone-shaped wall; and (d) a distance between the smaller end and the larger end as measured along a primary axis of the sealing structure, and wherein dimensions (a), (b), and (d) have a ratio relative to the thickness of the cone-shaped wall (c) of approximately: (a) 13:1 to 14:1; (b) 56:1 to 62:1; and (d) 7.5:1 to 8.5:1.

11. The earpiece of claim 10, wherein the perimeter of the first opening at the smaller end and the perimeter of the second opening at the larger end each comprise a minor dimension and a major dimension, wherein the minor dimension of the first opening is less than or equal to the major dimension of the first opening, and wherein the minor dimension of the second opening is less than or equal to the major dimension of the second opening.

12. The earpiece of claim 11, wherein a ratio of the minor dimension of the first opening to the major dimension of the first opening is equal to approximately: 0.62-0.72, and wherein a ratio of the minor dimension of the second opening to the major dimension of the second opening is equal to approximately: 0.9-1.0.

13. The earpiece of claim 10, wherein dimensions (a) and (b) have a ratio of approximately: 0.18 to approximately 0.28.

14. The earpiece of claim 10, wherein dimensions (c) and (d) have a ratio of approximately: 0.10 to approximately 0.15.

15. The earpiece of claim 10, wherein the passageway comprises a notch along an inner surface thereof for matingly engaging the mount, wherein the notch permits flexion of the body during coupling or decoupling of the body from the mount and provides sufficient hoop stress around the mount to retain the eartip on the mount during use of the earpiece, wherein the hoop stress is equal to approximately 1 kilogram (kg) to approximately 5 kg.

16. The earpiece of claim 10, wherein the shape of the sealing structure is further defined by an additional dimension comprising: (e) a taper angle of the cone-shaped wall between the first opening and the second opening, wherein the taper angle is equal to approximately 25 degrees to approximately 35 degrees.

17. The earpiece of claim 16, wherein the ratio of dimensions (a), (b), (c) and (d), and the taper angle (e), yield a defined set of best-fit shapes for a statistically representative group of ear canal shapes, wherein the defined set comprises approximately 5-10 best-fit shapes.

18. An eartip configured to couple with an electronics module on an earphone earpiece, the eartip comprising:

a body comprising a passageway for matingly coupling with a mount on the electronics module, the passageway comprising a notch along an inner surface thereof; and a sealing structure coupled with the body, the sealing structure comprising a substantially conical shape for conforming to an entrance of an ear canal of a user, wherein the sealing structure is defined by a cone-shaped wall having a smaller end and a larger end, wherein a shape of the sealing structure is defined by dimensions comprising:

(a) a perimeter of a first opening at the smaller end;

(b) a perimeter of a second opening at the larger end;

(c) a thickness of the cone-shaped wall; and (d) a distance between the smaller end and the larger end as measured along a primary axis of the sealing structure, wherein the notch in the body permits flexion of the body during coupling or decoupling of the body from the mount and provides sufficient hoop stress around the mount to retain the eartip on the mount during use of the earphone earpiece, wherein the hoop stress is equal to approximately 1 kilogram (kg) to approximately 5 kg, and wherein the notch extends entirely axially through the passageway.

19. An eartip configured to couple with an electronics module on an earphone earpiece, the eartip comprising:

a body comprising a passageway for matingly coupling with a mount on the electronics module, the passageway comprising a notch along an inner surface thereof; and a sealing structure coupled with the body, the sealing structure comprising a substantially conical shape for conforming to an entrance of an ear canal of a user, wherein the sealing structure is defined by a cone-shaped wall having a smaller end and a larger end, wherein a shape of the sealing structure is defined by dimensions comprising:

(a) a perimeter of a first opening at the smaller end;

(b) a perimeter of a second opening at the larger end;

(c) a thickness of the cone-shaped wall; and (d) a distance between the smaller end and the larger end as measured along a primary axis of the sealing structure, wherein the notch in the body permits flexion of the body during coupling or decoupling of the body from the mount and provides sufficient hoop stress around the mount to retain the eartip on the mount during use of the earphone earpiece, wherein dimensions (a), (b) and (d) have a ratio relative to the thickness of the cone-shaped wall (c) of approximately: (a) 13:1 to 14:1; (b) 56:1 to 62:1; and (d) 7.5:1 to 8.5:1, wherein (c) is equal to approximately 0.9 to approximately 1.1 millimeters, and wherein the shape of the sealing structure is further defined by an additional dimension comprising: (e) a taper angle of the cone-shaped wall between the first opening and the second opening, wherein the taper angle is equal to approximately 25 degrees to approximately 35 degrees.

* * * * *